US012774499B2

(12) United States Patent
Kinzel et al.

(10) Patent No.: US 12,774,499 B2
(45) Date of Patent: Oct. 27, 2026

(54) METHOD FOR OPERATING A BLAST FURNACE INSTALLATION

(71) Applicant: PAUL WURTH S.A., Luxembourg (LU)

(72) Inventors: Klaus Peter Kinzel, Sandweiler (LU); Miriam Valerius, Saarburg (DE); Cristiano Castagnola, Genoa (IT); Lorenzo Micheletti, Castagneto Carducci (IT)

(73) Assignee: PAUL WURTH S.A., Luxembourg (LU)

( * ) Notice: Subject to any disclaimer, the term of this patent is extended or adjusted under 35 U.S.C. 154(b) by 656 days.

(21) Appl. No.: 18/022,617

(22) PCT Filed: Sep. 9, 2021

(86) PCT No.: PCT/EP2021/074750
§ 371 (c)(1),
(2) Date: Feb. 22, 2023

(87) PCT Pub. No.: WO2022/053538
PCT Pub. Date: Mar. 17, 2022

(65) Prior Publication Data

US 2024/0018614 A1 Jan. 18, 2024

(30) Foreign Application Priority Data

Sep. 9, 2020 (LU) ..... 102055

(51) Int. Cl.
*C21B 5/06* (2006.01)

(52) U.S. Cl.
CPC ..... *C21B 5/06* (2013.01); *C21B 2100/22* (2017.05); *C21B 2100/282* (2017.05)

(58) Field of Classification Search
CPC . C21B 5/06; C21B 2100/22; C21B 2100/282; Y02P 10/122; Y02P 10/25
(Continued)

(56) References Cited

U.S. PATENT DOCUMENTS 2,862,808 A * 12/1958 De Jahn ..... C21B 13/0086 266/217
3,909,446 A * 9/1975 Miyashita ..... C01B 3/22 75/495
2019/0382277 A1* 12/2019 Speth et al. ..... C01C 1/04

FOREIGN PATENT DOCUMENTS

CN 103276133 A 9/2013
CN 110267916 A 9/2019
(Continued)

OTHER PUBLICATIONS

Chinese Office Action for corresponding application 2021800549229, Office Action dated Mar. 15, 2025.
(Continued)

*Primary Examiner* — Danielle M. Carda
(74) *Attorney, Agent, or Firm* — CANTOR COLBURN LLP

(57) ABSTRACT

A method for operating a blast furnace for producing of pig iron, including heating a stream of hydrocarbon gas and a stream of steam in a first heater to provide a heated stream of hydrocarbon gas and steam, feeding and partially reforming the heated stream of hydrocarbon gas and steam in a pre-reformer to provide a stream of partially reformed syngas, heating a first stream of blast furnace gas from the blast furnace and the stream of partially reformed syngas in a second heater, before or after their mixing together, to provide a heated carbon feed stream, reforming the heated carbon feed stream in a secondary reformer to provide a second stream of syngas, and
(Continued)

feeding said second stream of syngas to the shaft of the blast furnace.

30 Claims, 2 Drawing Sheets

(58) Field of Classification Search
USPC ..... 75/468
See application file for complete search history.

(56) References Cited

FOREIGN PATENT DOCUMENTS

| | | | |
|---|---|---|---|
| EP | 2886666 | A1 | 6/2015 |
| WO | 2015078962 | A1 | 6/2015 |
| WO | 2018162576 | A1 | 9/2018 |

OTHER PUBLICATIONS

Xu Li-hao "Influence of inlet gas components on the diesel steam reforming of proton exchange membrane fuel cells for hydrogen production", Journal of University of Science and Technology Beijing, vol. 34 No. 6, Jun. 2012.
International Search Report for corresponding application PCT/EP2021/074750 filed Sep. 9, 2021; Mail date Dec. 9, 2021.
Written Opinion for corresponding application PCT/EP2021/074750 filed Sep. 9, 2021; Mail date Dec. 9, 2021.

* cited by examiner

METHOD FOR OPERATING A BLAST FURNACE INSTALLATION

TECHNICAL FIELD

The present disclosure generally relates to a method for operating a blast furnace installation as well as to such a blast furnace installation.

BACKGROUND ART

Despite alternative methods, like scrap melting or direct reduction within an electric arc furnace, the blast furnace today still represents the most widely used process for steel production. One of the concerns of a blast furnace installation is the blast furnace gas (BFG) exiting the blast furnace. Since this gas exits the blast furnace at its top it is commonly also referred to as "top gas". While, in the early days, this blast furnace gas may have been allowed to simply escape into the atmosphere, this has later been avoided by using it in BFG fed power plants in order not to waste the energy content of the gas and cause an undue burden on the environment. One component in the blast furnace gas is $CO_2$, which is environmentally harmful and is mainly useless for industrial applications. Indeed, the waste gas exiting the power plant fed with the blast furnace gas typically comprises a concentration of $CO_2$ as high as 20 vol % to 40 vol %. The blast furnace gas being combusted usually comprises besides the before mentioned $CO_2$ considerable amounts of $N_2$, CO, $H_2O$ and $H_2$. The $N_2$ content, however, largely depends on whether hot air or (pure) oxygen is used for the blast furnace.

Mainly in order to reduce the amount of coke or other carbon source used, a suggestion was made to recover the blast furnace gas from the blast furnace, treat it to improve its reduction potential and to inject it back into the blast furnace to aid the reduction process. One method for doing this is reducing the $CO_2$ content in the blast furnace gas by Pressure Swing Adsorption (PSA) or Vacuum Pressure Swing Adsorption (VPSA), such as disclosed in patent application EP 2 886 666 A1. PSA/VPSA installations produce a first stream of gas which is rich in CO and $H_2$ and a second stream of gas rich in $CO_2$ and $H_2O$. The first stream of gas can be used as reduction gas and fed back into the blast furnace. One example for this approach is the ULCOS (Ultra Low $CO_2$ Steelmaking) process, where apart from the recycled first stream of gas, pulverized coal and cold oxygen are fed into the blast furnace. This type of furnace is also referred to as "top gas recycling OBF" (oxygen blast furnace).

The second stream of gas can be removed from the installation and, after extraction of the remaining calorific value, disposed of. This disposal controversially consists in pumping the $CO_2$ rich gas into pockets underground for storage. Furthermore, although PSA/VPSA installations allow a considerable reduction of $CO_2$ content in the blast furnace gas from about 35% to about 5%, they are very expensive to acquire, to maintain and to operate and further they need a lot of space.

It has also been proposed to use the blast furnace gas as a reforming agent for hydrocarbons in order to obtain a synthesis gas (also referred to as syngas) that can be used for several industrial purposes. According to a common reforming process, the blast furnace gas is mixed with a fuel gas that contains at least one hydrocarbon (e.g. lower alkanes). In a so-called dry reforming reaction, the hydrocarbons of the fuel gas react with the $CO_2$ in the blast furnace gas to produce $H_2$ and CO. At the same time the hydrocarbons react with the $H_2O$ in the blast furnace gas also producing $H_2$ and CO by so called steam reforming reaction. Either way, a synthesis gas is obtained that has a significantly increased concentration of $H_2$ and CO.

The problems with the above-mentioned solutions are that they require expensive and technically complex equipment and/or they are not transposable to blast furnace operation.

BRIEF SUMMARY

The present disclosure provides a new method for operating a blast furnace installation, i.e. a blast furnace and its ancillary equipment, as well as a corresponding blast furnace installation, allowing for reducing the $CO_2$ emissions resulting from the traditional blast furnace steel making and for at least partially overcoming the above-mentioned problems.

The present disclosure further proposes, in a first aspect, a method for operating a blast furnace for producing pig iron, comprising the steps of (a) heating a stream of hydrocarbon gas and a stream of steam in a first heater to provide a heated stream of hydrocarbon gas and steam, (b) feeding and partially reforming the heated stream of hydrocarbon gas and steam in a pre-reformer to provide a stream of partially reformed syngas, preferably wherein 2 to 25%, preferably 5 to 18% of methane (equivalent) contained in the hydrocarbon gas has been converted to CO and $H_2$, more preferably according to the thermodynamic equilibrium at operation temperatures between 400 and 550° C. and pressures between 1 and 4 barg, (c) heating a first stream of blast furnace gas from the blast furnace and the stream of partially reformed syngas in a second heater, before or after their mixing together, to provide a heated carbon feed stream, (d) reforming the heated carbon feed stream in a secondary reformer to provide a second stream of syngas, and (e) feeding said second stream of syngas to the shaft of the blast furnace.

In a second aspect, the present disclosure proposes blast furnace installation for producing pig iron comprising a blast furnace provided with gas inlets in the shaft arranged for feeding a second stream of syngas to the blast furnace. Said blast furnace further comprises a first heater in fluidic connection with a source of a stream of hydrocarbon gas and a source of a stream of steam, said first heater being arranged for heating said stream of hydrocarbon gas and said stream of steam to provide a heated stream of hydrocarbon gas and steam, and the first heater being in fluidic downstream connection with an inlet of a pre-reformer. Said pre-reformer is arranged for partially reforming the heated stream of hydrocarbon gas and steam to provide a stream of partially reformed syngas. Said blast furnace further comprises a second heater in fluidic connection with the top of the blast furnace arranged for conveying a first stream of blast furnace gas, said second heater being arranged for heating said first stream of blast furnace gas and said stream of partially reformed syngas, either separately or mixed, to provide a heated carbon feed stream; and a secondary reformer in fluidic connection with the second heater, said secondary reformer being arranged for converting the heated carbon feed stream to a second stream of syngas and being in fluidic downstream connection with said gas inlets in the shaft of the blast furnace. Advantageously, said blast furnace installation is configured for being operated by implementing a method according to the first aspect and as described more in detail below.

The disclosure thus proposes an integrated method and a corresponding installation allowing for operating a blast furnace more efficiently, with a reduced coke and other carbon source rate and with a smaller $CO_2$ footprint.

Indeed, the present inventors have found that this syngas production technology may advantageously be applied to a mix of hydrocarbon gas and blast furnace gas, thereby providing a syngas with compositions, which are particularly suitable to the feeding within the shaft of the blast furnace. In fact, hydrocarbon gas fed first to the pre-reformer undergoes a partial steam reforming before being subjected to a secondary reforming in the presence of blast furnace gas at higher temperatures. As the blast furnace gas has a reduced content of carbon compared to natural gas, an increase of the percentage of blast furnace gas in the feeding of the secondary reformer is possible, but values like critical ratios, e.g. steam to carbon ratio and maximum acceptable component concentrations in the product syngas should be maintained. For this reason, it may be advantageous to limit the proportion of blast furnace gas to be mixed with the hydrocarbon gas stream in order to facilitate the process operation.

Indeed the inventors determined that a particularly advantageous syngas quality can be obtained by controlling the Steam/Carbon ($H_2O/C$) molar ratio for the pre-reformer, depending on its operational pressure and related possible operating temperature at values from 0.3 to 0.7 mol/mol, more ideally between 0.35 and 0.65 mol/mol and preferably between 0.4 and 0.6 mol/mol. The pre-reformer's operation is preferably near the thermodynamic equilibrium, for which the conversion of methane depends on the operating conditions like temperature and pressure. The exact molar ratio of blast furnace gas to hydrocarbon gas for the secondary reformer is depending on the blast furnace gas composition and for common compositions typically controlled to about 2 to 6, ideally to about 2.5 to 5 and preferably to about 3 to 4.5.

One of the major advantages of the present method and installation is that by reconditioning part of the blast furnace gas for re-use, the overall $CO_2$ production of the blast furnace operation can be substantially reduced.

Furthermore, the injection of the resulting syngas to the shaft of the blast furnace allows for significantly reducing the amount of coke and/or other carbon source per ton of pig iron produced, also called coke rate. Additionally the injection of syngas in the shaft of the blast furnace is enabling higher tuyere injection of pulverized coal or natural gas or other material. Thus further amounts of coke can be replaced allowing indirectly to further reduce the operational cost of the blast furnace and in function of the carbon content of the injected material also the $CO_2$ emissions.

Moreover, whereas in other industries the pressure level of the reformers are relatively high, mostly above 20 bara or even above 40 bara, in a blast furnace application the required pressure level is 2 to 6 bara only. This has an important impact on the operating conditions and limits of the reforming equipment such as carbon formation and equilibrium conversion. Whereas the lower pressure level will favor a higher methane conversion at the same temperature level, it unfortunately also favors the formation of carbon, reason for which the utilization of a pre-reformer as described herein is specifically advantageous in the syngas production for its utilization in the blast furnace.

These and further advantages of the present method for operating a blast furnace, as well as the presently disclosed blast furnace installation will be further detailed below.

In the present method and blast furnace installation, the stream of hydrocarbon gas and the stream of steam are either heated separately in the first heater and then mixed together before entering or in the pre-reformer or heated as a pre-mixed stream of hydrocarbon gas and steam.

The temperature of the heated stream of hydrocarbon gas and/or of the heated stream of steam, or the heated stream of hydrocarbon gas and steam, when entering the pre-reformer in step (b) generally is between 300° C. and 600° C., ideally between 400° C. and 500° C., preferably from 425° C. to 480° C. The operation temperature of the pre-reformer is generally chosen according to the pressure conditions in between 400 and 550° C. for reducing or avoiding deposition of carbon on the catalyst.

It has been found that it may be desirable or beneficial for the operation of the blast furnace to add hydrogen, in particular so-called renewable or "green" hydrogen at an appropriate location of the process stream. In this context, renewable or "green" hydrogen is hydrogen ($H_2$) produced by electrolysis of water using electricity coming from renewable sources such as wind, solar or hydropower. As first option, this stream of hydrogen can be added before or after the heating of the hydrocarbon gas stream in the first heater before step (b) (i.e. upstream or downstream of the first heater, but upstream of the pre-reformer) which leads to lower conversion of methane in the pre-reformer at a given temperature in comparison without hydrogen addition, but carbon deposition is partially suppressed and the pre-reformer can be operated at higher temperatures e.g. up to 700° C. As second option, hydrogen can be added to the stream of partially reformed syngas fed to the secondary reformer, before or after being heated in the second heater before step (d) (i.e. upstream or downstream of the second heater, but upstream of the secondary reformer), also reducing carbon deposition. As third option hydrogen can be added to the second stream of syngas after the secondary reformer before step (e) to adapt its temperature to the required temperature level of syngas for the shaft injection or if the hydrogen is pre-heated to the same temperature level. All mentioned cases of integrating hydrogen in the process can be combined and the stream(s) of $H_2$ will advantageously be preheated. The preheating of the hydrogen generally is realized in appropriate heat exchangers, such as a fourth heater or heat exchanger, which ideally is/are integrated in the off-gas process line of the other heat exchangers. The location of adding the hydrogen is therefor also depending on the temperature level of preheating.

The inventors did not only identify that by feeding the pre-reformer with feed gases heated to such temperatures, the second stream of syngas leaving the downstream secondary reformer reaches temperatures of about 900 to 1100° C., ideally about 1000° C., which are the temperatures required for syngas shaft injection into the blast furnace. Moreover, this allows for a partial reforming ($CH_4$ conversion) of 2 to 25 mol %, preferably 5 to 18 mol % in the pre-reformer thereby alleviating the reforming work in the downstream secondary reformer. As already mentioned above, a further advantage of the pre-reforming as described herein is that higher hydrocarbons are eliminated/degraded at relatively low temperatures, thereby reducing the risk of soot/solid carbon deposition in the secondary reformer or in any interposed conducts, heaters, etc. Indeed, higher hydrocarbons tend to thermal reactions leading to non-saturated components and carbon, especially when heated up to relatively high temperatures, such as between 700 and 1000° C., i.e. temperatures measured in the secondary reformer. In other words the present method and blast furnace installation can thus make use of a large range of hydrocarbon sources as hydrocarbon gas. Using the partially reformed gas in which the higher hydrocarbons have been converted allows heating up to higher temperatures in the second heater and secondary reformer without, or at least with considerably less, undesirable carbon deposition. For further reduction of carbon deposition (so-called whisker carbon) in the secondary reformer, low and well controlled amounts of $H_2S$ can be added to the heated carbon feed stream before the secondary reformer to passivate or stabilize the catalyst, e.g. nickel catalyst, thereby strongly reducing carbon deposition on the catalyst.

Catalysts for syngas generation are typically group VIII metals, such as rhodium, platinum, palladium, ruthenium, cobalt, nickel, and iridium, which are either supported on oxide substrates or used unsupported. Key figures for the choice of catalyst is thereby the conversion rate, selectivity, thermal stability, preventing carbon formation and of course the price. The before listed parameter are depending on the feed and reaction conditions. The catalyst pore size, the space velocity and the catalyst geometry have a considerable effect on syngas selectivity and reaction rates. Using a pre-reformer and a secondary reformer offers the possibility of using two different catalysts according to different reforming conditions. Therefor the costs of the catalyst can be reduced and longer lifetimes of the more expensive catalyst in the secondary reformer can be achieved.

Moreover, potential sulfurous components, $H_2S$ and others such as mercaptan and thioether compounds, present in the hydrocarbon gas will deposit on the pre-reformer's catalyst, thereby protecting the catalyst in the downstream secondary reformer from sulfur poisoning.

The partial reforming in step (b) can be done in a variety of known reforming reactors configured for steam reforming. Advantageously however, the partial reforming in step (b) is effected in a heat exchanger type reformer as a pre-reformer. Being itself an endothermic reaction, the steam reforming of hydrocarbons requires a significant heat input to obtain the desired conversion to hydrogen and carbon monoxide. In conventional steam reformers, heat transfer takes place by radiation, whereas in heat exchange type reformers a significant part of the heat transfer takes place by convection with hot exhaust gas or hot process gas (as will be further explained below), whereby the thermal efficiency can be increased compared to the radiant solution. Further to their high thermal efficiency, heat exchange reformers are very compact.

In preferred embodiments, the first heater and the second heater are configured as heat exchangers using waste heat generated downstream in the method by heat integration. Advantageously, the (residual) heat from the off-gas/exhaust gas of the second heater is conveyed back as a heating medium to be used (in a so-called fluidic heating connection) in heating said upstream first heater. Hence, in particularly beneficial embodiments of the present disclosure, the effluent/waste heat from steps downstream are used upstream in counter flow heat exchange (hence the direction of the fluidic heating connection is opposite to that of the fluidic connection of the process streams), preferably in said heat exchangers and in said heat exchange type pre-reformer, thereby significantly increasing the method's efficiency. The terms "upstream" and "downstream" as used herein always refer to the direction of flow of the streams of reagents and products involved in the syngas production (process flow) and not to the direction of the counter flowing heating medium (fluidic heating connection).

The secondary reformer in step (d) can be a so-called dry reformer or an autothermal reformer.

In first variants, the secondary reformer is a mixed dry and steam reformer, for simplicity reasons and according common understanding simply called dry reformer in this document. The main reactions within the secondary reformer are the endothermic reactions of dry reforming in the presence of $CO_2$, i.e. $CH_4+CO_2=2CO+2H_2$ and the steam reforming in presence of steam i.e. $CH_4+H_2O=CO+3H_2$.

In such variants, the secondary reformer thus generally requires heat input to allow for the conversion of the carbon feed stream into a stream of syngas useable in blast furnace. The carbon feed stream is therefore heated in the second heater to appropriate temperatures after step (c), such temperatures generally being between 500° C. and 800° C., preferably between 600° C. and 750° C., more preferably between 650° C. and 700° C.

Furthermore, step (d) generally also comprises heating the secondary dry reformer by any appropriate means, such as with a burner burning a fuel gas, but more preferably by burning a second stream of blast furnace gas in a burner in the presence of air, oxygen-enriched air or even oxygen, thereby also obtaining a hot exhaust gas. Using oxygen-enriched air or oxygen to burn the second stream of blast furnace gas, probably in combination with waste gas recycling for controlling the flame temperature, is particularly beneficial if the resulting exhaust gas is also (partially) fed to the secondary reformer itself as an additional source of $CO_2$ which also reduces the $N_2$ content in the resulting second stream of syngas. In this context, the expression "oxygen-enriched air" means that oxygen gas ($O_2$) is added to air to raise the proportion of oxygen within the resulting oxygen-enriched gas mixture, such as to values from 23 to 85 vol % or above, preferably from 60 to 75 vol %.

The usage of pure oxygen or oxygen enriched air, leading to low nitrogen concentrations, offers also benefits for carbon capture installation.

Further to the counter current flow heat integration mentioned above, the use of a dry reformer as secondary reformer allows recovering (residual) heat from this heated dry reformer itself and the heat of the exhaust gas of its burner for using it to heat the upstream second heater, preferably in combination with the already described further counter current flow heat transfer to the pre-reformer and the first heater when configured as heat exchangers. Hence, the heat from the hot exhaust gas is preferably used to heat the upstream second heater, the pre-reformer and/or the first heater, preferably sequentially the upstream second heater, the pre-reformer and the first heater, in that order.

Some of the advantages and benefits of these first variants are:

- Due to pre-reformer with approx. 2-25% methane (equivalent) conversion, higher energy efficiency as a corresponding process without pre-reformer
- Since the blast furnace gas is not added to pre-reformer, a lower overall pressure drop is obtained
- Heat exchangers and pre-reformer are low cost equipment
- Separation of pre-reforming, heating and secondary reforming allows to more easily design and operate each step considering carbon deposition, catalyst poisoning and this especially also in view of changing blast furnace gas composition in function of the blast furnace operation.

In second variants, the secondary reforming in step (d) is effected in an autothermal reformer, also known as ATR, in the presence of appropriate amounts of oxygen. Autothermal reforming combines the steam and dry reforming reactions and fuel oxidation in a single unit, the exothermic oxidation providing the heat for the endothermic reforming reactions.

In such a configuration including an ATR as secondary reformer, the pre-reforming step results in a considerable reduction of energy requirement for the secondary reforming, thereby also reducing the oxygen consumption, which in turn helps to significantly increase the reduction potential of the (second stream of) syngas produced in the secondary reformer. The reduction potential is thereby defined as molar ratio $(CO+H_2)/(CO_2+H_2O)$ The temperature of the heated carbon feed stream after step (c) is adjusted as required and will generally be between 750° C. and 950° C., preferably between 800° C. and 900° C. Accordingly, step (d) preferably further comprises heating the second heater by burning an appropriate fuel gas, or advantageously by burning a second stream of blast furnace gas with air, oxygen-enriched air or oxygen in a burner associated to the second heater. Again as mentioned above in the context of other variants, the exhaust gas produced by the combustion in the burner can be (partially) fed to the secondary ATR as an additional source of $CO_2$.

Some of the advantages and benefits of these second variants are:

- Due to pre-reformer with approx. 2-25% methane (equivalent) conversion, higher reduction potential syngas as with ATR only
- Higher $CO_2$ reduction potential then with only ATR due to increased blast furnace gas utilization
- Lower $O_2$ requirements as with ATR reformer only
- Heat exchangers and pre-reformer are low cost equipment
- Separation of pre-reforming, heating and secondary reforming allows to more easily design and operate each step considering carbon deposition, catalyst poisoning and this especially also in view of changing blast furnace gas composition in function of the blast furnace operation.

Additionally, a third stream of blast furnace gas can be advantageously fed to the pre-reformer in step (b), preferably after said third stream of blast furnace gas has been heated, e.g. in the first heater, and/or subjected to a gas cooling and/or cleaning step, preferably a vapor removal step, a dust removal step, metals removal step, HCl removal step and/or sulfurous component removal step.

It has been found that it may be desirable or beneficial for the operation of the blast furnace to add hydrogen, in particular so-called renewable or "green" hydrogen at an appropriate location of the process stream. In case of a dry reformer as a secondary reformer, hydrogen is preferably added to the first stream of partially reformed syngas, to the first stream of blast furnace gas and/or to the heated carbon feed stream before step (d). In case of an autothermal reformer as a secondary reformer, hydrogen is most preferably added to the second stream of syngas before step (e). In this context, renewable or "green" hydrogen is hydrogen ($H_2$) produced by electrolysis of water using electricity coming from renewable sources such as wind, solar or hydropower.

In cases of integration of hydrogen in the process, it will advantageously be preheated. The preheating of the hydrogen generally is realized in appropriate heat exchangers, such as a fourth heater or heat exchanger, which ideally is/are integrated in the off-gas process line of the other heat exchangers.

Before being sent to the stack, the heating medium or exhaust gas e.g. leaving the first heater, still contains heating energy which may be of use in the present method and blast furnace installation. In advantageous embodiments, the stream of heating medium or exhaust gas is passed in a preheater to preheat the first, second and/or third stream of blast furnace gas; the air, oxygen-enriched air or oxygen for use in the burner; and/or the stream(s) of hydrogen (in which latter case, the preheater is the fourth heater mentioned above).

Alternatively or additionally, the stream of heating medium or exhaust gas is optionally further subjected to one or more exhaust treatments aiming e.g. at further reducing the $CO_2$ footprint of the present method. This can be achieved by Carbon Capture and Utilization (CCU) for example by using the exhaust gas (or part thereof) within secondary reformer as explained above, as such or after treatment in a $CO_2$ removal unit using Pressure Swing Adsorption (PSA), Vacuum Swing Adsorption (VSA) or Vacuum Pressure Swing Adsorption (VPSA), amine treatment (also called amine scrubbing), in which a $CO_2$ enriched stream and a $CO_2$ depleted stream are obtained, the latter being sent to the stack. Alternatively, reducing the $CO_2$ footprint can be achieved by Carbon Capture and Storage (CCS), wherein the $CO_2$ is captured as in the case of CCU but thereafter storing it such that it will not enter the atmosphere, normally in an underground geological formation. The before described method is especially interesting if oxygen or oxygen enriched air is used as combustion oxygen source for the burner, due to lower concentration of nitrogen in the exhaust gas.

In particularly advantageous embodiments of the disclosure, the second stream of syngas obtained in step (d) has a chemical composition fulfilling the following constraints:

$CH_4<5$ vol.-% and $(CO+H_2)/(H_2O+CO_2)>7$.

The expression "in fluidic connection" means that two devices are connected by conducts or pipes such that a fluid, e.g. a gas, can flow from one device to another. As already suggested above, the expression "in fluidic heating connection" means that two devices are connected by conducts or pipes such that a heating medium, e.g. a gas, can flow from one device to another. The direction of flow within the fluidic heating connection for heat integration is opposite that of the fluidic connection, meaning that the heat flow is in counter current flow to that of the process streams. These expressions include means for changing this flow, e.g. valves or fans for regulating the mass flow, compressors for regulating the pressure, etc., as well as control elements, such as sensors, actuators, etc. necessary or desirable for an appropriate control of the blast furnace operation as a whole or the operation of each of the elements within the blast furnace installation.

The expression "hydrocarbon gas" in the context of the present disclosure means any hydrocarbon having up to ten carbon atoms per molecule, preferably up to six carbon atoms, which is in gaseous state at the temperatures of the first heater, i.e. having a boiling point below 200° C., preferably below 100° C. Such hydrocarbon gas thus comprises natural gas, i.e. a naturally occurring hydrocarbon gas mixture of fossil origin consisting primarily of methane and commonly including varying amounts of other higher alkanes, but also gases with similar hydrocarbon constituents, such as naphtha, e.g. light naphtha or even fractions of heavy naphtha, biogas, coke oven gas, etc.

The expression "stream of steam" as used herein means a stream containing steam, i.e. gaseous water, in significant amounts, e.g. generally more than 50 mol %, preferably more than 80 mol %, most preferably more than 90 mol %.

Such a stream of steam may further contain inert constituents, such as $N_2$, but also small amounts of gaseous constituents that may act as reagents within the pre-reformer, such as $CO_2$, CO or $H_2$. Preferably, however the stream of steam does not contain more than 10% of $N_2$.

"Shaft feeding", "feeding . . . to the shaft of a blast furnace" or "gas inlets in the shaft" implies the injection of a material above the hot blast (tuyere) level, i.e. above the bosh, preferably within the gas solid reduction zone of ferrous oxide above the cohesive zone.

The expression "dry reforming" in the context of the present disclosure does not only include the reaction of methane with $CO_2$, rather also the reaction of methane with steam remaining in the syngas coming from pre-reformer and a specific steam content in the blast furnace gas.

"About" in the present context, means that a given numeric value covers a range of values form −10% to +10% of said numeric value, preferably a range of values form −5% to +5% of said numeric value.

BRIEF DESCRIPTION OF THE DRAWINGS

Preferred embodiments of the disclosure will now be described, by way of example, with reference to the accompanying drawings in which.

Figure 1:
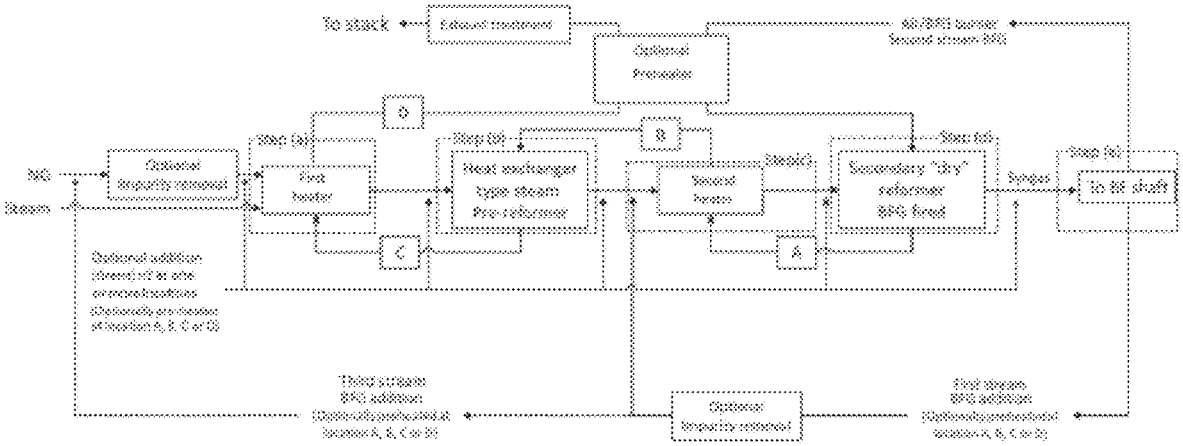
FIG. 1 is a schematic flowsheet view of an embodiment of a first variant of a blast furnace installation configured to implement the present blast furnace operating method.

Further details and advantages of the present disclosure will be apparent from the following detailed description of several not limiting embodiments with reference to the attached drawings.

DETAILED DESCRIPTION

The requirements for the syngas for its utilization in the blast furnace are different to its requirements for applications in other industries.

The main requirements for syngas utilization in the blast furnace are:

Reduction Degree and Temperature Level of the Syngas:

In other industries normally the syngas is produced and then cooled to separate the excess of steam from the syngas. Thereby only cooled gas is used in the downstream processes. In existing industrial applications beside the steel industry, a high reduction degree is therefore not important. In steel industry however a high reduction degree, preferably above 7, is preferable and essential for process efficiency, whereas the reduction degree is defined as: $(cCO+cH_2)/(cH_2O+cCO_2)$.

Furthermore, high temperatures of syngas are favored compatible to the temperature level required for shaft injection in order to allow maximum thermal efficiency. Thus the temperature should be in the order of 900 to 1100° C. to allow its injection in the shaft above the cohesive zone of a blast furnace.

Ratio $H_2$/CO

In the other industries, beside steel industry, the syngas is used for specific applications, such as pure hydrogen production, ammonia or the production of other chemical components. Thereby a specific ratio of hydrogen to CO is generally required.

In comparison, the objective by using syngas in the blast furnace is reduction of ore, which is achieved with both reducing components, CO and hydrogen. While there is a difference between the reduction of ore with CO or hydrogen, this difference is relatively marginal considering that syngas is only one part of the reducing gas used within the blast furnace.

Pressure Level

Whereas in other industries the pressure level of the reformers are relatively high, mostly above 20 bara or even above 40 bara, in the blast furnace application the required pressure level is 2 to 6 bara only. This has important impact on the operating conditions and limits of the reforming equipment such as carbon formation and equilibrium conversion. Whereas the lower pressure level will favor a higher methane conversion at the same temperature level, it unfortunately also favors the formation of carbon, reason for which the utilization of a pre-reformer is specifically advantageous in the syngas production for its utilization in the blast furnace.

$CO_2$ Emissions

Coke is the main energy input in the blast furnace iron making. From the economic and $CO_2$ point of view, this is the less favorable energy source. Substitution of coke by other energy sources, mostly injected at tuyere level, is widely employed. Due to cost reasons mostly pulverized coal is injected, however in countries with low natural gas price, this energy is used. Often residues like waste plastics are also injected in the blast furnace.

These auxiliary fuels may have a positive impact on the $CO_2$ emissions from the blast furnace steel making, meanwhile their utilization is limited to process reasons and very often these limits are already attained today. The blast furnace produces blast furnace gas (BFG), which contains up to approximately 40% of the energy input to the blast furnace. This gas is generally used for internal heat requirements in the steel plant, but also for electric energy production. For the objective of reducing the $CO_2$ footprint of a blast furnace based steel production, one important strategy is thus to use this BFG for metallurgical reasons and apply other $CO_2$ lean energies such as green electric energy for the remaining energy requirement of the steel plant.

Hence, the synthesis gas production should, beside the utilization of a $CO_2$ lean hydrocarbon, also integrate blast furnace gas as much as possible in order to improve the $CO_2$ emission reduction potential from the blast furnace iron making.

Hydrogen Addition

If desired or beneficial a stream of hydrogen, preferably renewable hydrogen, can be added to the method, in particular before the pre-reformer and/or the secondary reformer reducing carbon deposition, thereby the hydrogen stream can be added before or after the first heater or before or after the second heater. Before addition, it may be beneficial to heat the stream of hydrogen, preferably using a further heat exchanger installed within the fluidic heating connections of the heat integrating conducts, such as in any one or more of locations A (if applicable), B, C or D.

Impurities

Due to the utilization of coal and coke as well as often-cheap secondary fuels as waste plastics or tar being used in the blast furnace, the typical and detrimental chemical components, such as chlorine and sulfur containing molecules, are part of the blast furnace gas. When using this gas for the production of syngas, these components may lead to quick poisoning of the reforming catalyst if not properly pre-treated.

Reforming and Auxiliary Technologies for Syngas Production:

Reforming Reactions

Hydrocarbon gas reforming, such as natural gas reforming can principally be performed by following reactions:

Partial oxidation in the presence of oxygen: $CH_4+\frac{1}{2}O_2-CO+H_2$

This reaction is strongly exothermic and releases a high amount of energy.

Steam reforming in the presence of steam: $CH_4+H_2O=CO+3H_2$

Dry reforming in the presence of $CO_2$: $CH_4+CO_2=2CO+2H_2$

These two last reactions are strongly endothermic and require a lot of heat.

Reforming technologies and its adaptation to blast furnace shaft injection

For ATR reforming technologies, the thermodynamic equilibrium at the desired best reduction potential of the gas, leads to a temperature of the syngas, which is still too low for its injection in the shaft. In fact, increasing the temperature further result in higher oxygen requirement and decreased reduction potential of the syngas, which is not favorable for the intended use.

Pre-Heating of the Feed Gases

The inventors found that to improve the situation a preheating of the feed gases could be applied. The thermodynamic composition of the syngas at its optimum could be obtained by pre-heating the feed gases to between 400 and 550° C. Indeed, with such a pre-heating, not only the reduction potential of the syngas can be increased, but the desired syngas temperature of about 900 to 1100° C. can also be obtained.

Pre-Reforming:

When using a pre-reformed gas or partially reformed gas, which has been reformed at moderate temperatures of up to 600° C., preferably between 430 and 500° C. and most preferably between 450 and 480° C., the reduction potential of the gas from the secondary reformer can be further improved. Methane conversions of about 2 to 18% can be achieved alleviating the required work for the secondary reformer. Further advantages are the elimination of higher hydrocarbons before entering the secondary reformer and thus reduction of possible soot formation. In addition, the catalyst in the pre-reforming reactor is normally a high surface type that can bear higher poison concentrations as the catalyst being employed in the secondary reformer. Furthermore, sulfur will deposit on the catalyst of the pre-reformer thereby protecting the catalyst of the secondary reformer from poisoning by sulfur.

When using the ATR technology as secondary reformer the pre-reforming of the methane results in a considerable reduction of energy requirement for that second process step allowing to reduce the oxygen consumption. This in turn significantly increases the reduction potential of the synthesis gas produced in the secondary reformer.

Additionally, the pre-reforming will preferably be realized with indirect energy supply. The heat source may result from burning blast furnace gas in a burner further improving the $CO_2$ balance of the process in combination with the steel production.

Heating of the Partially Reformed Gas

Higher hydrocarbons tend to thermal reactions leading to non-saturated components and carbon. This might lead to carbon deposit in heat exchangers if unreformed gas is heated up to relatively high temperatures, typically between 700 and 1000° C. Using the pre-reformed gas in which the higher hydrocarbons are converted allows heating up to high temperatures.

When using the ATR technology as a secondary reformer the high inlet temperature of pre-reformed gas results in a considerable reduction of energy requirement for that process step, which allows a significantly reduction of oxygen consumption.

Additionally, this helps to increase the reduction potential of the synthesis gas produced in the secondary reformer significantly.

In addition, the pre-heating will preferably be realized with indirect heating. The heat source may result from the burning of blast furnace gas which leads to further improvement of the $CO_2$ balance regarding the process in combination with the steel production.

In the following two different variants of the method for operating a blast furnace and the blast furnace installation of the disclosure using either dry reforming or ATR as a secondary reformer with corresponding auxiliary technologies are shown in relation with the annexed drawings.

FIG. 1 illustrates an embodiment of a first variant of the present method for operating a blast furnace comprising the shaft injection of a stream of syngas at temperatures of 900 to 1100° C., e.g. about 1000° C. and at a pressure of 1 to 6 barg.

This stream of syngas has been produced starting with natural gas (NG) optionally cleaned from impurities, e.g. about 100 $Nm^3/h$, and steam, e.g. about 50 $Nm^3/h$, which are heated in a first heater before or after being mixed together, preferably in a first heat exchanger at temperatures from about 400° C. to 550° C. before being partially reformed in a pre-reformer, preferably a heat exchanger type steam pre-reformer, where 2 to 18% of the methane contained in the natural gas is converted to CO and $H_2$, thereby forming a stream of partially reformed syngas.

This stream of partially reformed syngas is then mixed with a first stream of blast furnace gas, e.g. about 300 to 400 $Nm^3/h$ at a pressure of about 1.5 to 6.5 barg, either before or after their heating in a second heater, preferably at temperatures from about 500 to 800° C., more preferably from about 600° C. to 700° C., to form a heated carbon feed stream. The blast furnace gas is generally first cooled to reduce its vapor content, cleaned, in particular by removing dust and/or HCl and/or metal compounds and/or sulfurous components. In preferred embodiments, this first stream of blast furnace gas can first be preheated, such as in any one or more of locations A, B, C or D.

Additionally, a third stream of blast furnace gas can be advantageously fed to the pre-reformer in step (b), preferably after said third stream of blast furnace gas has been heated in the first heater and/or subjected to a gas cooling and/or cleaning step, preferably a vapor removal step, a dust removal step, metals removal step, HCl removal step and/or sulfurous component removal step. Again, in preferred embodiments, this third stream of blast furnace gas can first be preheated, such as in any one or more of locations A, B, C or D.

The main reforming is done in the secondary reformer which in this case is a so-called dry reformer. The heat required for the dry reforming reaction is provided by a burner operated with a second stream of blast furnace gas, which is depending on the preheating temperature and the gas streams composition e.g. about 350 to 600 $Nm^3/h$, such as about 510 $Nm^3/h$, from the top of the blast furnace. This burner can be fed by air, oxygen-enriched air or even oxygen, in particular if the exhaust gas from the burner is reintroduced into the dry reformer as a $CO_2$ source.

The stream of syngas leaving the secondary dry reformer, e.g. about 550 to 700 $Nm^3/h$, such as about 640 $Nm^3/h$, has temperatures about 1000° C. and a pressure of about 1 to 6 barg and is thereafter directly injected into the shaft of the shaft furnace.

Advantageously, the residual heat from the secondary reformer resulting as hot exhaust gas, such as (part of) the exhaust gas from its burner, and can be used to heat the second heat exchanger, the remaining heat is then in turn used to heat the pre-reformer and still further the first heat exchanger, thereby forming an energy efficient counter current flow heat integration concept. When leaving the first heat exchanger, the gas can be released through the stack or further be treated, e.g. such as for making it suitable for carbon capture and storage or carbon capture and utilization, etc. In preferred embodiments, the exhaust gas leaving the first heater can be passed through a further heat exchanger, e.g. for preheating the second stream of blast furnace gas and/or the air, oxygen-enriched air or oxygen used in the burner of the secondary reformer.

Figure 2:
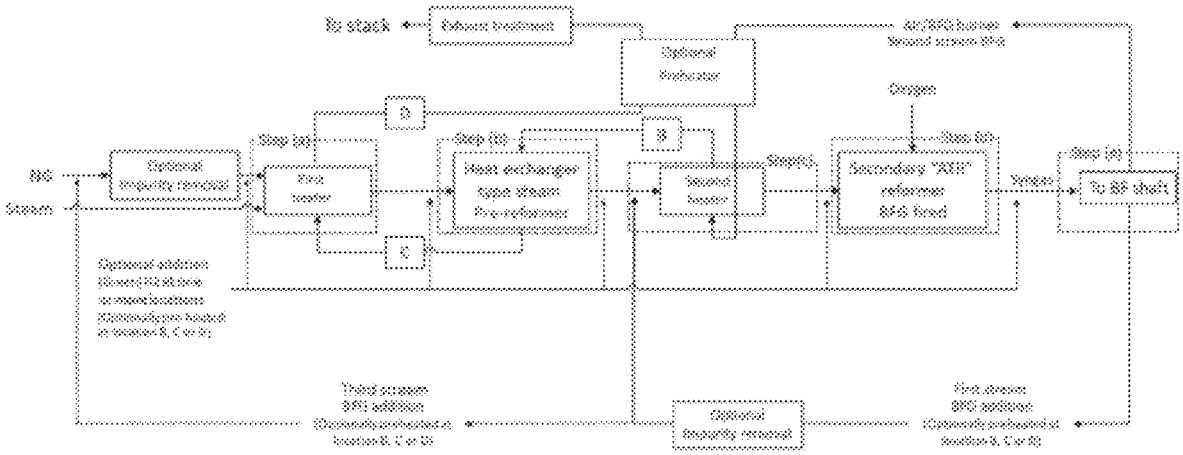
FIG. 2 is a schematic flowsheet view of an embodiment of a second variant of a blast furnace installation configured to implement the present blast furnace operating method.

FIG. 2 illustrates an embodiment of a second variant of the present method for operating a blast furnace comprising the shaft injection of a stream of syngas at temperatures of about 900 to 1100° C., e.g. about 1000° C. and at a pressure of about 1 to 6 barg.

This stream of syngas has been produced starting with natural gas (NG) optionally cleaned from impurities, e.g. about 100 $Nm^3/h$, and steam, e.g. about 50 $Nm^3/h$, which are heated in a first heater before or after being mixed together, preferably a first heat exchanger at temperatures from about 400° C. to 550° C. before being partially reformed in a pre-reformer, preferably a heat exchanger type steam pre-reformer, where 2 to 25% of the methane contained in the natural gas is converted CO and $H_2$, thereby forming a stream of partially reformed syngas.

This stream of partially reformed syngas is then mixed with a first stream of blast furnace gas, e.g. about 60 $Nm^3/h$ at a pressure of about 1.5 to 6.5 barg, either before or after their heating in a second heater, preferably at temperatures from about 750 to 950° C., preferably about 800° C. to 900° C., to form a heated carbon feed stream. In preferred embodiments, this first stream of blast furnace gas can first be preheated, such as in any one or more of locations B, C or D. As above, the blast furnace gas is generally first cooled and/or cleaned, in particular by vapor, dust, metals, sulfurous components and/or HCl removal.

The main reforming is done in the secondary reformer which in this case is an autothermal reformer. The heat required for the second heater can be provided by a burner attached to it and operated with a second stream of blast furnace gas, e.g. about 230 $Nm^3/h$, from the top of the blast furnace. This burner can be fed by air, oxygen-enriched air or even oxygen, in particular if the exhaust gas from the burner is reintroduced into the autothermal reformer. In the autothermal reformer oxygen is needed for the exothermic oxidation reaction. Hence, oxygen, e.g. about 40 $Nm^3/h$ is injected in the autothermal reformer, optionally preheated, such as in any one or more of locations B, C or D.

The stream of syngas leaving the secondary autothermal reformer, e.g. about 340 $Nm^3/h$ has temperatures about 1000° C. and a pressure of about 1 to 6 barg and is thereafter directly injected into the shaft of the shaft furnace.

Advantageously, the residual heat from the second heat exchanger resulting as hot gas, such as exhaust gas from its burner, can be used to heat the pre-reformer, the remaining heat is then in turn used to heat the first heat exchanger, thereby forming an energy efficient counter current flow heat integration concept. When leaving the first heat exchanger, the gas can be released through the stack or further be treated, e.g. such as for making it suitable for carbon capture and storage or carbon capture and utilization, etc. In preferred embodiments, the exhaust gas leaving the first heater can be passed through a further heat exchanger, e.g. for preheating the second stream of blast furnace gas and/or the air, oxygen-enriched air or oxygen used in the burner of the second heater.

The invention claimed is:

1. A blast furnace installation for producing pig iron comprising a blast furnace provided with gas inlets in a shaft arranged for feeding a second stream of syngas to the blast furnace, said blast furnace further comprising a first heater in fluidic connection with a source of a stream of hydrocarbon gas and a source of a stream of steam, said first heater being arranged for heating said stream of hydrocarbon gas and said stream of steam to provide a heated stream of hydrocarbon gas and steam, and the first heater being in fluidic downstream connection with an inlet of a pre-reformer, said pre-reformer being arranged for partially reforming the heated stream of hydrocarbon gas and steam to provide a stream of partially reformed syngas, a second heater in fluidic connection with a top of the blast furnace arranged for conveying a first stream of blast furnace gas, said second heater being arranged for heating said first stream of blast furnace gas and said stream of partially reformed syngas, either separately or mixed, to provide a heated carbon feed stream, wherein the pre-reformer is configured for operating a temperature in between 40° and 550° C. or wherein the pre-reformer is configured for operating at a temperature up to 700° C. when the blast furnace installation further comprises a source of a stream of $H_2$ in fluidic connection with the first heater and/or the pre-reformer; and a secondary reformer in fluidic connection with the second heater, said secondary reformer being arranged for converting the heated carbon feed stream to a second stream of syngas and being in fluidic downstream connection with said gas inlets in the shaft of the blast furnace.

2. The blast furnace installation as claimed in claim 1, wherein the blast furnace installation is configured for implementing a method for operating a blast furnace for producing pig iron, comprising the steps of heating a stream of hydrocarbon gas and a stream of steam in a first heater to provide a heated stream of hydrocarbon gas and steam, feeding and partially reforming the heated stream of hydrocarbon gas and steam in a pre-reformer to provide a stream of partially reformed syngas, heating a first stream of blast furnace gas from the blast furnace and the stream of partially reformed syngas in a second heater, before or after their mixing together, to provide a heated carbon feed stream, reforming the heated carbon feed stream in a secondary reformer to provide a second stream of syngas, and feeding said second stream of syngas to the shaft of the blast furnace.

3. The blast furnace installation as claimed in claim 1, wherein the first heater and the second heater are configured as heat exchangers and said second heater is in fluidic heating connection with said upstream first heater.

4. The blast furnace installation as claimed in claim 1, wherein the first heater and the second heater are configured as heat exchangers and the pre-reformer is a heat exchanger type reformer, the second heater being in fluidic heating connection with said heat exchanger type reformer and said heat exchanger type reformer being in fluidic heating connection with said first heater.

5. The blast furnace installation as claimed in claim 1, wherein the secondary reformer is a dry reformer.

6. The blast furnace installation as claimed in claim 5, wherein the dry reformer comprises a burner in fluidic connection with the top of the blast furnace arranged for conveying a second stream of blast furnace gas to said burner.

7. The blast furnace installation as claimed in claim 5, wherein the dry reformer is in fluidic heating connection with the upstream second heater.

8. The blast furnace installation as claimed in claim 1, wherein the secondary reformer is an autothermal reformer in fluidic connection with a source of oxygen.

9. The blast furnace installation as claimed in claim 8, wherein second heater comprises a burner in fluidic connection with the top of the blast furnace arranged for conveying a second stream of blast furnace gas to said burner.

10. The blast furnace installation as claimed in claim 1, wherein the second heater and/or the secondary reformer and/or the gas inlets in the shaft of the shaft furnace is/are in fluidic connection with a source of a stream of $H_2$, said fluidic connection(s) comprising a fourth heater for heating said stream of $H_2$.

11. The blast furnace installation as claimed in claim 1, wherein the fluidic connection with the top of the blast furnace arranged for conveying a first stream of blast furnace gas further comprises a gas cooling and/or cleaning plant, a vapor removal unit, a dust removal unit, metals removal unit, HCl removal unit and/or sulfurous component removal unit.

12. The blast furnace installation as claimed in claim 1, wherein the inlet of the pre-reformer is additionally in fluidic connection with the top of the blast furnace arranged for conveying a third stream of blast furnace gas to said pre-reformer, said fluidic connection for the third stream of blast furnace gas being in fluidic heating connection with the first heater.

13. A method for operating the blast furnace installation for producing pig iron of claim 1, comprising the steps of (a) heating a stream of hydrocarbon gas and a stream of steam in a first heater to provide a heated stream of hydrocarbon gas and steam, (b) feeding and partially reforming the heated stream of hydrocarbon gas and steam in a pre-reformer to provide a stream of partially reformed syngas, (c) heating a first stream of blast furnace gas from the blast furnace and the stream of partially reformed syngas in a second heater, before or after their mixing the first stream of blast furnace gas and the stream of partially reformed syngas together, to provide a heated carbon feed stream, (d) reforming the heated carbon feed stream in a secondary reformer to provide a second stream of syngas, and (e) feeding said second stream of syngas to the shaft of the blast furnace.

14. The method as claimed in claim 13, wherein the temperature of the heated stream of hydrocarbon gas and steam is between 300° C. and 600° C.

15. The method as claimed in claim 13, wherein 2 to 25 mol % of methane contained in the hydrocarbon gas has been converted to CO and $H_2$, at operation temperatures between 40° and 550° C. and pressures between 1 and 4 barg.

16. The method as claimed in claim 13, wherein 2 to 25 mol % of methane contained in the hydrocarbon gas has been converted to CO and $H_2$ and wherein a stream of $H_2$ is added upstream or downstream of the first heater before step (b) and the operation temperature of the pre-reformer is up to 700° C., said stream of $H_2$ having been heated.

17. The method as claimed in claim 13, wherein the first heater and the second heater are configured as heat exchangers and a heating medium from the second heater is used to heat said upstream first heater.

18. The method as claimed in claim 13, wherein the first heater and the second heater are configured as heat exchangers and the partial reforming in step (b) is effected in a heat exchanger type reformer, a heating medium from the second heater being used to heat said heat exchanger type reformer and said first heater.

19. The method as claimed in claim 13, wherein the reforming in step (d) is effected as dry reforming process.

20. The method as claimed in claim 19, wherein the temperature of the heated carbon feed stream after step (c) is between 500° C. and 800° C.

21. The method as claimed in claim 19, wherein step (d) further comprises heating the dry reformer by burning a second stream of blast furnace gas in a burner with air, oxygen-enriched air or oxygen and additionally obtaining a stream of hot exhaust gas.

22. The method as claimed in claim 21, wherein heat from the hot exhaust gas is used to heat the upstream second heater and/or the pre-reformer and/or the first heater, sequentially the upstream second heater, the pre-reformer and the first heater.

23. The method as claimed in claim 13, wherein the reforming in step (d) is effected in an autothermal reformer with the addition of oxygen.

24. The method as claimed in claim 23, wherein the temperature of the heated carbon feed stream after step (c) is between 750° C. and 950° C.

25. The method as claimed in claim 23, wherein step (d) further comprises heating the second heater by burning a second stream of blast furnace gas in a burner with air, oxygen-enriched air or oxygen and additionally obtain a stream of hot exhaust gas.

26. The method as claimed in claim 25, wherein heat from the hot exhaust gas is used to heat the upstream pre-reformer and/or the first heater.

27. The method as claimed in claim 13, wherein a stream of $H_2$ is added to the first stream of partially reformed syngas before step (c), to the first stream of blast furnace gas before step (c) and/or to the heated carbon feed stream before step (d) and/or to the second stream of syngas before step (e), said stream(s) of $H_2$ having been heated.

28. The method as claimed in claim 13, wherein the first stream of blast furnace gas is further subjected to a gas cooling and/or cleaning step, a vapor removal step, a dust removal step, metals removal step, HCl removal step and/or sulfurous component removal step, before being mixed with the stream of partially reformed syngas.

29. The method as claimed in claim 13, wherein a third stream of blast furnace gas is additionally fed to the pre-reformer in step (b), after said third stream of blast furnace gas has been heated in the first heater and/or subjected to a gas cooling and/or cleaning step, a vapor removal step, a dust removal step, metals removal step, HCl removal step and/or sulfurous component removal step.

30. The method as claimed in claim 13, wherein any exhaust gas produced in the method is subjected to one or more exhaust treatments before being released to the atmosphere, said exhaust treatments being selected from Carbon Capture and Utilization (CCU) and Carbon Capture and Storage (CCS), wherein the carbon capture is effected in a $CO_2$ removal unit using Pressure Swing Adsorption (PSA), Vacuum Swing Adsorption (VSA) or Vacuum Pressure Swing Adsorption (VPSA) or amine gas treatment (amine scrubbing).

* * * * *